US008305412B2

(12) United States Patent
Yamamoto et al.

(10) Patent No.: US 8,305,412 B2
(45) Date of Patent: Nov. 6, 2012

(54) IMAGE FORMING APPARATUS AND LIGHT INTENSITY CONTROL METHOD

(75) Inventors: Norihiro Yamamoto, Kanagawa (JP); Hidetoshi Yamashita, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 323 days.

(21) Appl. No.: 12/828,703

(22) Filed: Jul. 1, 2010

(65) Prior Publication Data

US 2011/0001788 A1 Jan. 6, 2011

(30) Foreign Application Priority Data

Jul. 6, 2009 (JP) ..... 2009-160080
Jun. 7, 2010 (JP) ..... 2010-129854

(51) Int. Cl.
*B41J 2/435* (2006.01)

(52) U.S. Cl. ..... 347/224

(58) Field of Classification Search ..... 347/224, 347/237; 356/217
See application file for complete search history.

(56) References Cited

U.S. PATENT DOCUMENTS

2007/0229647 A1* 10/2007 Kawano et al. ..... 347/224
2008/0266375 A1* 10/2008 Seki ..... 347/237
2008/0292342 A1 11/2008 Yamashita
2011/0102780 A1* 5/2011 Karassiouk ..... 356/217

FOREIGN PATENT DOCUMENTS

JP 2000-71510 3/2000
JP 3466599 8/2003
JP 2003-320703 11/2003
JP 2009-1006 1/2009

* cited by examiner

*Primary Examiner* — Stephen Meier
*Assistant Examiner* — Carlos A Martinez
(74) *Attorney, Agent, or Firm* — Oblon, Spivak, McClelland, Maier & Neustadt, L.L.P.

(57) ABSTRACT

An image forming apparatus includes a light source that outputs a plurality of laser beams and a control unit that adjusts the light intensity of each of the laser beams. The control unit calculates a correction value so that, when the laser beam is driven by a control value calculated by correcting a common control value using the correction value and adding a threshold to the corrected control value, the light intensity of the laser beam is equal to a target light intensity. The threshold is calculated so that, when the laser beam is driven by a control value calculated by multiplying the corrected control value by a predetermined factor, and adding the threshold to the multiplied control value, the light intensity of the laser beam is equal to the target light intensity multiplied by the predetermined factor.

5 Claims, 13 Drawing Sheets

FIG. 6

| ROM REGION | | |
|---|---|---|
| CHANNEL NUMBER | DEFAULT MONITOR VOLTAGE Vpd | DEFAULT CURRENT VALUE SW_A |
| ch1 | Vpd (1) | = (SW (1)+SW (2)+···SW (40))/40 |
| ch2 | Vpd (2) | |
| ch3 | Vpd (3) | |
| ch4 | Vpd (4) | |
| ch5 | Vpd (5) | |
| ⋮ | ⋮ | |
| ch39 | Vpd (39) | |
| ch40 | Vpd (40) | |

IMAGE FORMING APPARATUS AND LIGHT INTENSITY CONTROL METHOD

CROSS-REFERENCE TO RELATED APPLICATIONS

The present application claims priority to and incorporates by reference the entire contents of Japanese Patent Application No. 2009-160080 filed in Japan on Jul. 6, 2009 and Japanese Patent Application No. 2010-129854 filed in Japan on Jun. 7, 2010.

BACKGROUND OF THE INVENTION

1. Field of the Invention

The present invention relates to an image forming apparatus and a light intensity control method.

2. Description of the Related Art

A typical image forming apparatus forms a latent image on a drum-shaped photosensitive element by using a laser diode to irradiate the statically charged photosensitive element and then develops the latent image with developing materials, thereby forming an image. A typical laser diode emits from one to four or up to about eight laser beams from one semiconductor element.

In recent years, vertical cavity surface emitting lasers (VCSELs) have been used in practical applications, and it has been proposed that they are used in image forming apparatuses. A single chip of VCSEL can emit about 40 laser beams. Therefore, if such a VCSEL is used in an image forming apparatus to form a latent image, high-resolution, high-speed image formation, etc. will be achieved.

The high-speed formation of a high-resolution latent image cannot be achieved by simply using a VCSEL as a laser diode to form a latent image. For example, when a laser diode is used to form a latent image, a mechanism is needed that adjusts the light intensity of laser beams emitted by the laser diode to a target value. The VCSEL also needs a mechanism for adjusting the light intensity of the many laser beams emitted from its light emitting regions.

Because the number of laser beams emitted from a VCSEL is large, if light intensity control is made in the same manner for a VCSEL as it is for a laser diode emitting fewer number of laser beams, the time taken to control the light intensity is increased, which prevents any increase in the image forming speed. Furthermore, if part of the light intensity control over the laser beams is skipped, it is difficult to achieve high resolution.

Japanese Patent Application Laid-open No. 2009-1006 discloses a technology in which a current correction value is calculated depending on the output characteristics of the laser beam for each channel, and a common driving current that is used for every channel is corrected using the calculated correction value to obtain the light intensity of each laser beam. Thus, the light intensities of the laser beams are adjusted in an efficient manner and with a minimum increase in the circuit size.

When an image is formed using laser beams, problems occur related to shading. The laser beams strike a scanned surface after passing through an optical system that includes lenses, mirrors, etc. Therefore, the intensity of the laser beam varies over the scanned surface depending on image height (shading characteristics), and the shading characteristics affect the density of the formed image. Therefore, shading compensation is needed when an image is formed using laser beams.

For example, Japanese Patent No. 3466599 discloses a light intensity control technology in which the light intensity is assumed to be in direct proportion to the light emitting current. If light intensity correction data indicates a 10% increase in the light intensity at a certain image height, then the light intensity is increased by 10% by increasing the light emitting current by 10%. Japanese Patent Application Laid-open No. 2003-320703 discloses a shading compensation technology that is used with a light source unit that emits a plurality of beams of light.

However, it is difficult to implement accurate shading compensation using the technology disclosed in Japanese Patent Application Laid-open No. 2009-1006 because the threshold current is not adjusted even though adjustment of the threshold current is needed for accurate shading compensation.

In the technology disclosed in Japanese Patent No. 3466599, the light intensity is assumed to be in direct proportion to the light emitting current; however, the light intensity is not always in direct proportion to the light emitting current. Therefore, if the technology disclosed in Japanese Patent No. 3466599 is applied to the technology disclosed in Japanese Patent Application Laid-open No. 2003-320703, the light intensity of each laser beam may be not corrected to the target value. If the light intensity of each laser beam is set to an incorrect value, large differences may occur between the light intensities of the individual laser beams and, as a result, an image with periodical density unevenness (banding) may occur. Therefore, if the technology disclosed in Japanese Patent No. 3466599 is applied to the technology disclosed in Japanese Patent Application Laid-open No. 2003-320703, it is difficult to perform accurate shading compensation.

SUMMARY OF THE INVENTION

It is an object of the present invention to at least partially solve the problems in the conventional technology.

According to an aspect of the present invention there is provided an image forming apparatus including: a light source that outputs a plurality of laser beams; a splitting unit that splits each of the laser beams into a first laser beam that is used for light intensity control and a second laser beam that is used to scan a photosensitive element; a light-intensity-signal output unit that outputs for each of the first laser beams a corresponding light intensity signal that is indicative of the light intensity thereof; and a control unit that adjusts the light intensity of each of the laser beams to a target light intensity by referring to the light intensity signal. The control unit includes a common-control-value calculating unit that calculates a common control value that is used for light intensity control of every laser beam; a correction-value calculating unit that calculates a correction value for each of the laser beams, wherein the correction value is used to correct the common control value; and a threshold calculating unit that calculates a threshold of each of the laser beams, wherein the threshold corresponds to a value of current at which oscillation of the laser beam starts. The correction-value calculating unit calculates the correction value so that, when the laser beam is driven by a first control value, the light intensity of the laser beam is equal to the target light intensity, wherein the first control value is a value calculated by correcting the common control value using the correction value to obtain a corrected control value and adding the threshold to the corrected control value. The threshold calculating unit calculates the threshold so that, when the laser beam is driven by a second control value, the light intensity of the laser beam is equal to the target light intensity multiplied by a predetermined factor, wherein the second control value is a value calculated by correcting the common control value using the correction value to obtain the corrected control value, multiplying the corrected control value by the predetermined factor to obtain a multiplied control value, and adding the threshold to the multiplied control value.

According to another aspect of the present invention there is provided a light intensity control method performed by an image forming apparatus. The image forming apparatus includes: a light source that outputs a plurality of laser beams; a splitting unit that splits each of the laser beams into a first laser beam that is used for light intensity control and a second laser beam that is used to scan a photosensitive element; and a light-intensity-signal output unit that outputs for each of the first laser beams a corresponding light intensity signal that is indicative of the light intensity thereof. The light intensity control method comprising: calculating, by a common-control-value calculating unit, a common control value that is used for light intensity control of every laser beam; calculating, by a correction-value calculating unit, a correction value of each of the laser beams, wherein the correction value is used to correct the common control value; and calculating, by a threshold calculating unit, a threshold of each of the laser beams, wherein the threshold corresponds to a value of current at which oscillation of the laser beam starts. The correction-value calculating unit calculates, in the calculating, the correction value so that the light intensity of the laser beam is equal to a target light intensity when the laser beam is driven by a first control value, wherein the first control value is calculated by correcting the common control value using the correction value to obtain a corrected control value and adding the threshold to the corrected control value. The threshold calculating unit calculates, in the calculating, the threshold so that, when the laser beam is driven by a second control value, the light intensity of the laser beam is equal to the target light intensity multiplied by a predetermined factor, wherein the second control value is a value calculated by correcting the common control value using the correction value to obtain the corrected control value, multiplying the corrected control value by the predetermined factor to obtain a multiplied control value, and adding the threshold to the multiplied control value.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 6 is a schematic diagram that illustrates an example of the table structure of factory setting data;

DETAILED DESCRIPTION OF THE PREFERRED EMBODIMENTS

Image forming apparatuses and light intensity control methods according to exemplary embodiments of the present invention are described in detail below with reference to the accompanying drawings.

An image forming apparatus according to the present embodiment drives a VCSEL that emits laser beams from a plurality of channels in such a manner that each channel (i) ($1 \leqq i \leqq N$) is driven by a driving current I(i), where the driving current I(i) is calculated by "common-supply-current correction value SHD*beam-based current correction value DEV (i)*common supply current Isw+beam-based threshold current Ith(i)".

The common-supply-current correction value SHD is used for correcting the common supply current Isw in accordance with shading compensation. The beam-based current correction value DEV(i) is used to correct a current to control light-intensity for each laser-beam. The common supply current Isw is commonly used for every laser beam. The beam-based threshold current Ith(i) corresponds to a value of current at which oscillation of the laser beam starts in each channel.

The image forming apparatus according to the present embodiment includes a first control loop, a second control loop, and a third control loop. The first control loop adjusts, when the common-supply-current correction value SHD=SHD1, the beam-based current correction value DEV (i) so that the light intensity of the laser beam emitted from the channel (i) is equal to a target light value. The second control loop adjusts, when the common-supply-current correction value SHD=SHD1, a common-supply-current setting value SW so that the beam-based current correction value DEV(i) takes the maximum value and the minimum value within a certain range. The common-supply-current setting value SW is used to generate the common supply current Isw. The third control loop adjusts, when the common-supply-current correction value SHD=SHD2, a beam-based threshold-current setting value TH(i) so that, the light intensity of a laser beam when being driven by "common-supply-current correction value SHD2*beam-based current correction value DEV(i)*common supply current Isw+beam-based threshold current Ith(i)" is equal to the product of the light intensity of the laser beam when being driven by "common-supply-current correction value SHD1*beam-based current correction value DEV(i)*common supply current Isw+beam-based threshold current Ith(i)" and a multiplier (common-supply-current correction value SHD2/common-supply-current correction value SHD1).

Because, as described above, the image forming apparatus of the present embodiment includes the first to the third control loops, the image forming apparatus can perform accurate light intensity control and also perform accurate shading compensation at a high speed even in a VCSEL having many channels.

Figure 1:
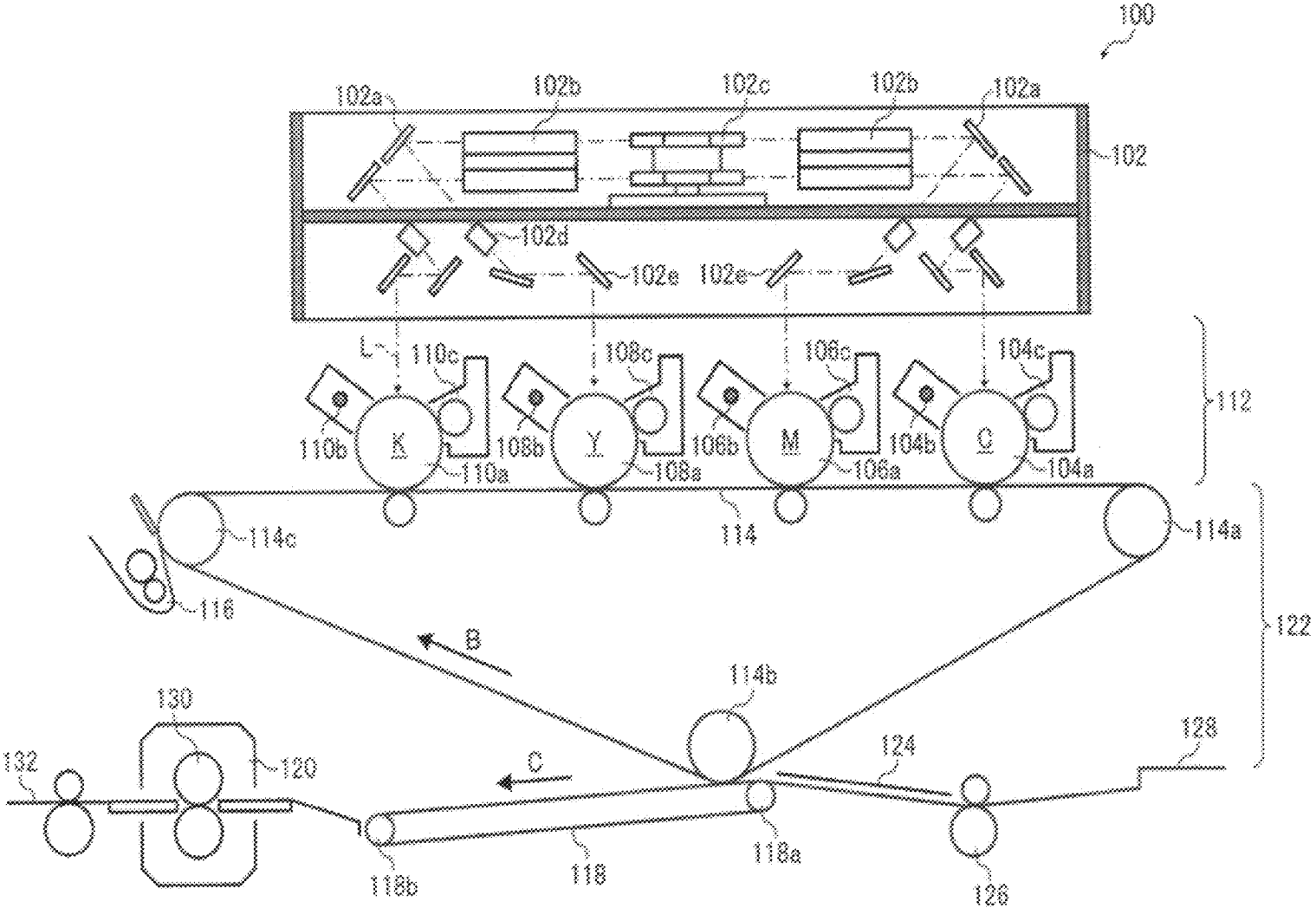
FIG. 1 is a schematic diagram of the configuration of an image forming apparatus used in the present embodiment as an example.

FIG. 1 is a schematic diagram of the configuration of an image forming apparatus 100 used in the present embodiment as an example. As shown in FIG. 1, the image forming apparatus 100 includes an optical device 102 that includes a laser diode, a polygon mirror, etc.; an image forming unit 112 that includes drum-shaped photosensitive elements, charging devices, developing devices, etc.; a transferring unit 122 that includes an intermediate transfer belt, etc.

The optical device 102 deflects light beams emitted from a light source (not shown), such as a laser diode or similar, by using a polygon mirror 102*c* and causes the deflected light beams to enter fθ lenses 102*b*. There are several light beams for each of colors including cyan (C), magenta (M), yellow (Y), and black (K). After passed through the fθ lenses 102*b*, the laser beams are reflected by reflecting mirrors 102*a* and the reflected laser beams enter WTL lenses 102*d*. The WTL lenses 102*d* shape the light beams and then deflect the shaped light beams toward reflecting mirrors 102*e* so that the deflected light beams, as exposing light beams L, form images on photosensitive elements 104*a*, 106*a*, 108*a*, and 110*a* of the image forming unit 112.

As described above, exposure of the photosensitive elements 104*a*, 106*a*, 108*a*, and 110*a* to the light beams L is implemented by usage of a plurality of optical elements; therefore, timing-synchronization is performed in regard to both the main-scanning direction and the sub-scanning direction. The main-scanning direction corresponds to, herein, a scanning direction of the light-beam; and the sub-scanning direction corresponds to a direction perpendicular to the main-scanning direction or, in the example shown in FIG. 1, a direction of rotation of the photosensitive elements 104*a*, 106*a*, 108*a*, and 110*a*.

Each of the photosensitive elements 104*a*, 106*a*, 108*a*, and 110*a* includes a conductive drum-shaped member that is made of, for example, aluminum and a photoconductor layer that is formed on the conductive drum-shaped member. The photoconductor layer includes at least a charge generating layer and a charge transporting layer. Chargers 104*b*, 106*b*, 108*b*, and 110*b* charge the surfaces of the photoconductor layers of the photosensitive elements 104*a*, 106*a*, 108*a*, and 110*a*, respectively. Each charger includes a corotron, a scorotron, a charging roller, or similar.

After charged by the chargers 104*b*, 106*b*, 108*b*, and 110*b*, the photosensitive elements 104*a*, 106*a*, 108*a*, and 110*a* are exposed to the light beams L and, thus, latent images are formed on the surfaces of the photosensitive elements 104*a*, 106*a*, 108*a*, and 110*a*. The latent images formed on the photosensitive elements 104*a*, 106*a*, 108*a*, and 110*a* are developed into toner images by developers 104*c*, 106*c*, 108*c*, and 110*c*, respectively. Each developer includes a developing sleeve, a developing-material supply roller, a squeeze blade, etc.

The toner images are transferred from the photosensitive elements 104*a*, 106*a*, 108*a*, and 110*a* onto an intermediate transfer belt 114 of the transferring unit 122. The intermediate transfer belt 114 is rotated in the direction indicated by an arrow B by conveying rollers 114*a*, 114*b*, and 114*c*. The C, M, Y, and K toner images are transferred onto the intermediate transfer belt 114 and are moved to a secondary transferring unit. To the secondary transferring unit, an image receiving material 124, such as a quality paper sheet of a plastic sheet, is conveyed from an image-receiving-material accommodating unit 128, such as a paper feed cassette, by a conveying roller 126. The secondary transferring unit applies a secondary transfer bias so that the image receiving material 124 is attracted to the secondary transfer belt 118 and, thus, a multi-color toner image formed on the secondary transfer belt 118 is transferred onto the image receiving material 124. The secondary transfer belt 118 is conveyed in the direction indicated by an arrow C by conveying roller 118*a* and 118*b* and enters to a fixing device 120 with the image receiving material 124. After the multi-color image is transferred from the intermediate transfer belt 114, residual toners are removed from the intermediate transfer belt 114 by a cleaning unit 116 using a cleaning blade for the next image forming process.

The fixing device 120 includes a fixing member 130 such as a fixing roller made of, for example, silicon rubber or fluorine-containing rubber. The fixing device 120 applies heat and pressure to the image receiving material 124 with the multi-color toner image and conveys them to outside of the image forming apparatus 100 as a printed material 132.

A detecting device (not shown) is arranged near an end edge of each of the photosensitive elements 104*a*, 106*a*, 108*a*, and 110*a* in the main-scanning direction and detects a shift in the sub-scanning direction.

Figure 2:
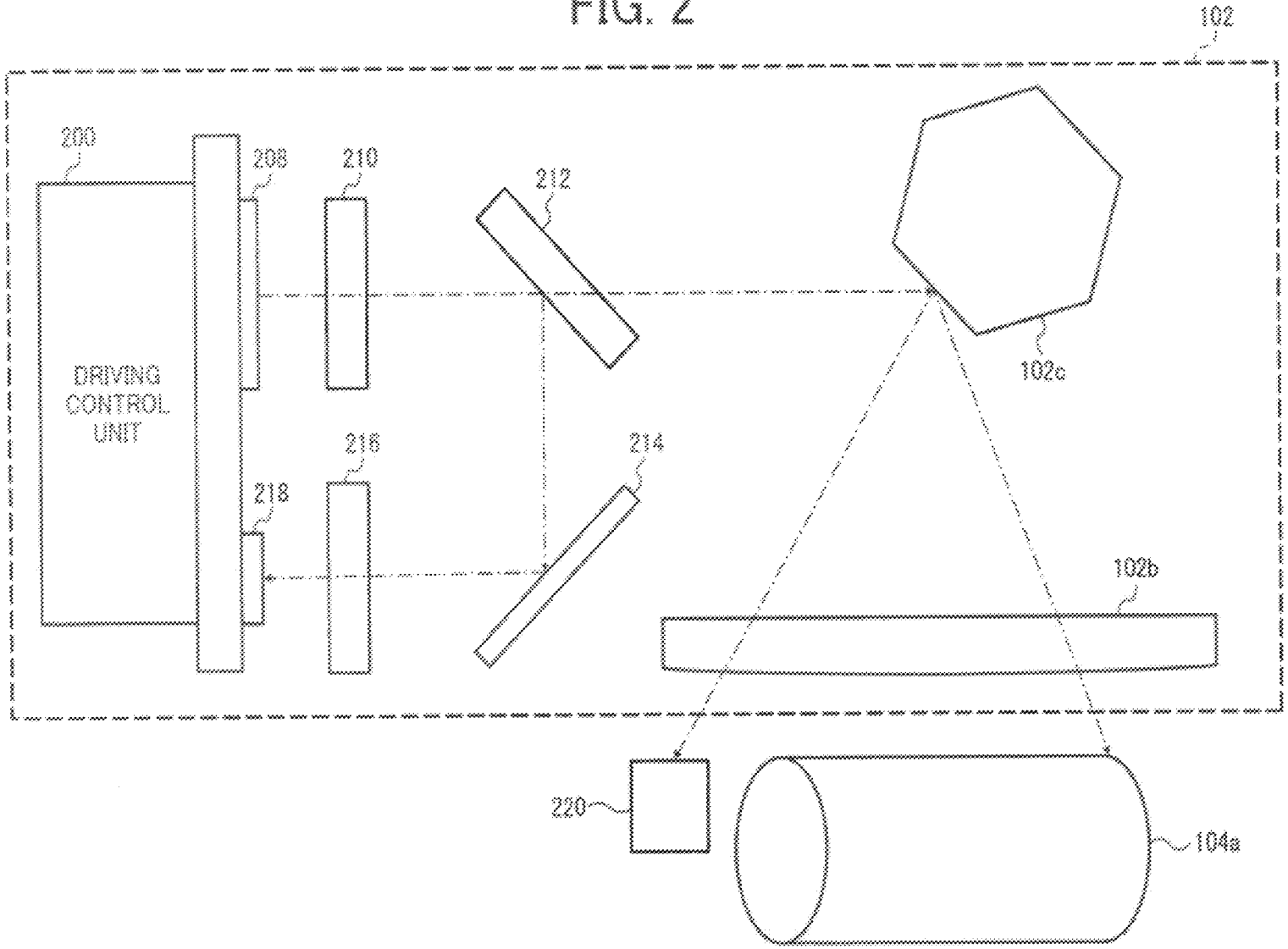
FIG. 2 is a schematic diagram of the optical system of an optical device used in the present embodiment as an example.

FIG. 2 is a schematic diagram of the optical system of the optical device 102 used in the present embodiment as an example. As shown in FIG. 2, the optical device 102 includes a driving control unit 200, a VCSEL 208, a coupling optical element 210, a half mirror 212, the polygon mirror 102*c*, the fθ lens 102*b*, a totally reflecting mirror 214, a second condenser lens 216, and a photoelectric conversion element 218.

The driving control unit 200 controls driving of the VCSEL 208 (an example of a light source). More particularly, the driving control unit 200 supplies a driving current to the VCSEL 208, thereby activating the VCSEL 208. The activated VCSEL 208 emits a plurality of laser beams. In the present embodiment, the VCSEL 208 emits 40 laser beams in associated with 40 channels, respectively, but is not limited thereto.

The laser beams are converted to parallel light by effect of the coupling optical element 210, and the parallel laser beams enter the half mirror 212. The half mirror 212 (an example of a splitting unit) is, for example, a mirror coated with a dielectric multilayer and splits each of the incoming laser beams into a scanning beam used to scan a photosensitive element (an example of a second laser beam) and a monitor beam used for light intensity control (an example of a first laser beam).

The scanning beam is deflected by the polygon mirror 102*c* and the deflected scanning beam strikes, after passing through the fθ lens 102*b*, the photosensitive element 104*a*. A synchronization detecting device 220 is arranged near a position of the photosensitive element 104*a* at which scanning starts. The synchronization detecting device 220 includes a photodiode (PD) and detects the laser beam (scanning beam) and issues a synchronization signal. The synchronization signal provides timings for various operations.

The monitor beam is reflected by the totally reflecting mirror 214 toward the second condenser lens 216, and the reflected monitor beam enters, after passing through the second condenser lens 216, the photoelectric conversion element 218 that is made of a photodiode or similar. The photoelectric conversion element 218 (an example of a light-intensity-signal output unit) outputs a monitor voltage Vpd (an example of a light intensity signal) to the driving control unit 200 in accordance with the light intensity of the monitor beam. The driving control unit 200 (an example of a control unit) converts the received monitor voltage Vpd to a monitor signal and generates, for example, VCSEL control data in accordance with the light intensity of the laser beam indicated by the monitor signal. The generated VCSEL control data is used for control over the driving current.

Figure 3:
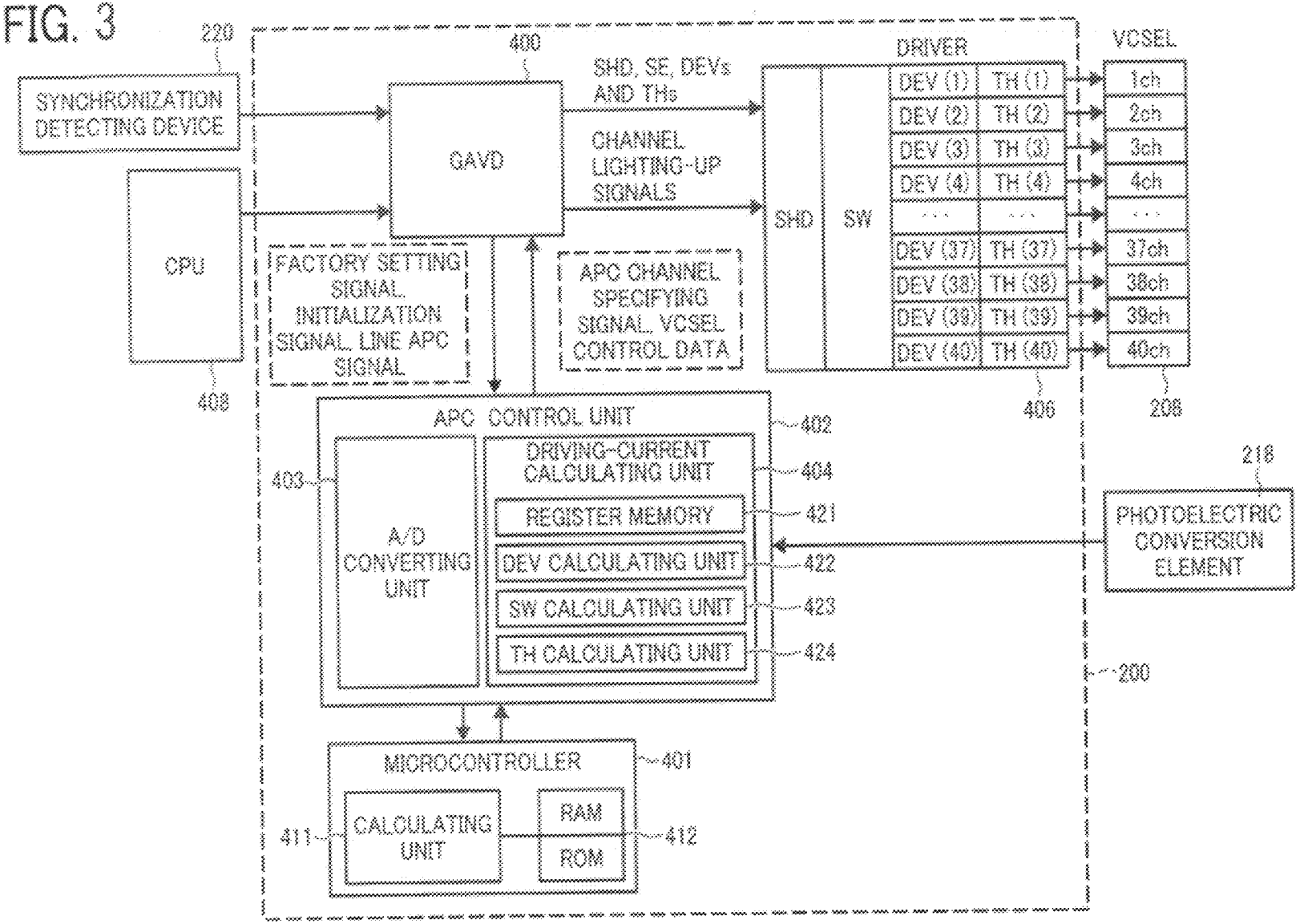
FIG. 3 is a block diagram of the functional configuration of a driving control unit used in the present embodiment as an example.

FIG. 3 is a block diagram of the functional configuration of the driving control unit 200 used in the present embodiment as an example. As shown in FIG. 3, the driving control unit 200 includes a VCSEL controller 400, a driver 406, a microcontroller 401, and an APC control unit 402.

The VCSEL controller (hereinafter, "GAVD") 400 is an application specific integrated circuit (ASIC). The GAVD 400 receives a control signal from a CPU 408, which controls image formation of the image forming apparatus 100, and controls driving of the VCSEL 208. In response to commands received from the CPU 408, the GAVD 400 issues signals for controlling the VCSEL 208, such as a factory setting signal, an initialization signal, a line auto power control (APC) signal, and an inter-sheet APC signal, thereby starts factory setting, initialization, line APC, and inter-sheet APC. In parallel to the factory setting and the initialization by the GAVD 400, the synchronization detecting device 220 starts detection of the laser beam (scanning beam).

The line APC is a control to compensate intensities of the laser beams in each time when the laser beam scans in the main-scanning direction, during when the image forming apparatus 100 is in active and forming an image on a recording sheet. The inter-sheet APC is a control to compensate intensities of the laser beams in a manner different from the manner of the line APC during an interval between printing processes of two successive sheets, when two or more sheets are continuously printed out.

Figure 4:
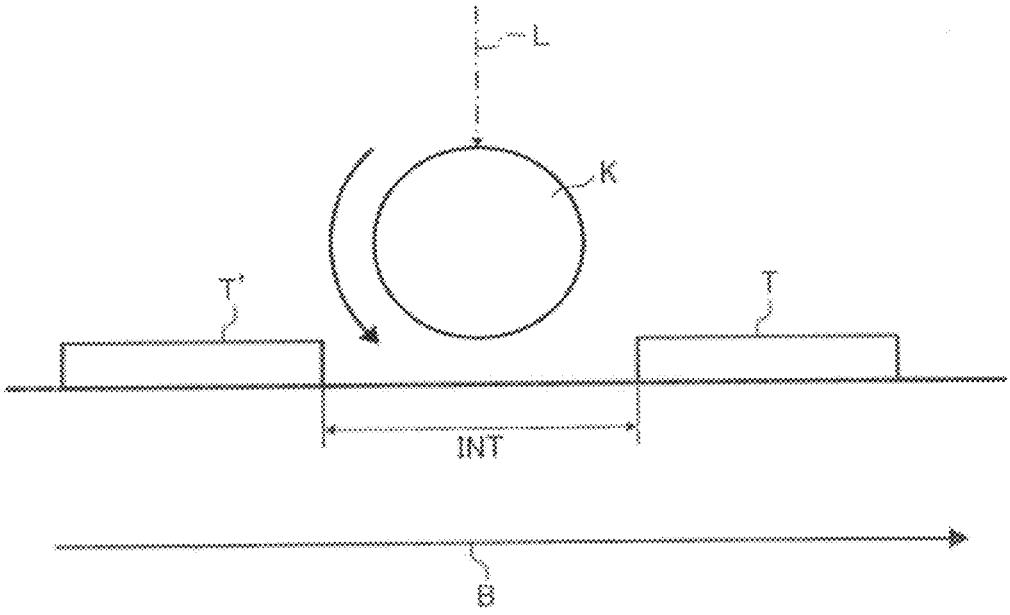
FIG. 4 is a schematic diagram of an example of inter-sheet APC.

FIG. 4 is a schematic diagram of an example of the inter-sheet APC. In the example of the inter-sheet APC shown in FIG. 4, the intermediate transfer belt moves in the direction indicated by an arrow B. A compensation of intensity of the laser beam is made during an interval INT between when the light beam L scans a photosensitive element K to form a toner image T to be transferred onto an arbitrary recording sheet and when the light beam L scans the photosensitive element K to form a toner image T' to be transferred onto the recording sheet that follows the arbitrary recording sheet. As just described, in the inter-sheet APC, intensities of the laser beams are corrected after an image is printed onto an arbitrary recording sheet and before another image is printed onto the recording sheet that follows the arbitrary recording sheet.

Referring back to FIG. 3, the driver 406 supplies a driving current to the VCSEL 208. More particularly, the driver 406 receives a control signal from the GAVD 400 and supplies driving currents to the VCSEL 208 in accordance with the control signal, thereby activating the VCSEL 208. The activated VCSEL 208 generates laser beams. Although, in the present embodiment, the number of laser beams emitted from the VCSEL 208 is 40 and the 40 laser beam correspond to 40 channels (ch1 to ch40), respectively, the configuration is not limited thereto.

Figure 5:
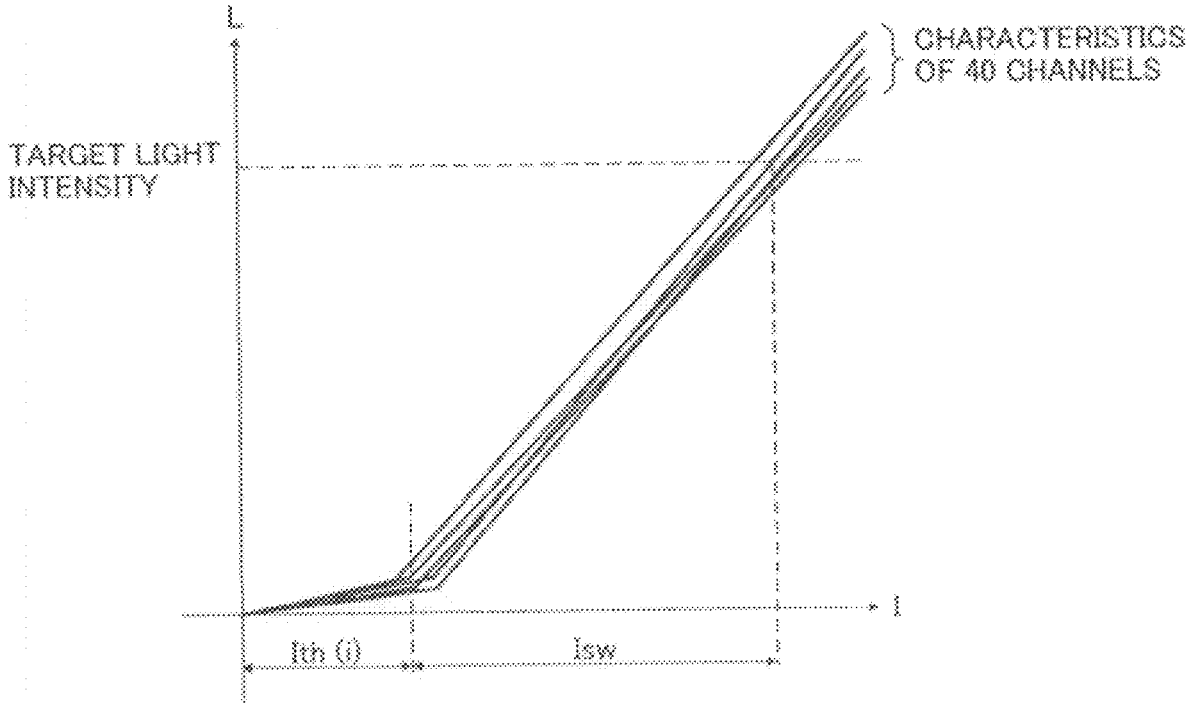
FIG. 5 is a graph of an output characteristic of a laser beam output, as an example, from a VCSEL according to the present embodiment.

FIG. 5 is a graph of an output characteristic (hereinafter, "I-L characteristic") of a laser beam output, as an example, from the VCSEL 208 according to the present embodiment, more particularly, a graph of intensity of light that is output when each laser diode element of the VCSEL 208 is supplied with a current. In the present embodiment, the VCSEL 208 is made up of laser diode elements for 40 channels.

As shown in FIG. 5, in regard to a current supplied to the VCSEL 208, the beam-based threshold current Ith(i), which corresponds to a value of current at which oscillation of the laser beam starts in each laser-diode-element, and the common supply current Isw, which provides substantially the same effect for every laser beam, can be defined. The levels of outputs L that are output from laser diode elements of the VCSEL 208 when being supplied with the same driving current level I are different from each other depending on the difference between characteristics of the elements. Therefore, even in the initial settings, the driving currents that are necessary for the individual laser diode elements to output the laser beams with the same light intensity are different from each other.

The default value of the common supply current Isw is a probe current value that is set on the basis of measurements at a factory before shipment and registered to the later-described microcontroller 401. The default value of the common supply current Isw is used for initialization of the laser diode elements. The parameter i represents each channel for a laser beam emitted from the VCSEL 208 and, in the present embodiment, i ranges from 1 to 40.

Referring back to FIG. 3, the microcontroller 401 includes a calculating unit 411 and a memory 412. The memory 412 has both a ROM region and a RAM region. The ROM region of the memory 412 stores therein factory setting data, etc. The RAM region of the memory 412 is used as a register memory that stores therein values necessary for processing, etc.

When the microcontroller 401 receives a command from the GAVD 400 via the APC control unit 402, the calculating unit 411 calculates, using the factory setting data and the light intensity of the laser beam stored in the memory 412, the default values of the control values used by the later-described APC control unit 402. The microcontroller 401 then outputs the default values calculated by the calculating unit 411 to the APC control unit 402.

FIG. 6 is a schematic diagram that illustrates an example of the table structure of the factory setting data. As shown in FIG. 6, the ROM region stores therein both a default monitor voltage Vpd and a default current value SW_A in associated with the channel number indicative of the channel allocated to a laser diode element of the VCSEL 208. The default monitor voltage Vpd is set at a time of shipment as the monitor voltage of the photoelectric conversion element 218. The default current value SW_A is the average of default current values SW(i) each assigned to the corresponding laser diode element, and is to provide monitor light intensity during light intensity control.

Referring back to FIG. 3, the APC control unit 402 includes an A/D converting unit 403 and a driving-current calculating unit 404. The A/D converting unit 403 converts the monitor voltage Vpd that is received from the photoelectric conversion element 218 into a monitor signal. The driving-current calculating unit 404 generates VCSEL control data in accordance with the light intensity of the laser beam indicated by the monitor signal that is converted by the A/D converting unit 403 and outputs the VCSEL control data to the driver 406 via the GAVD 400. The A/D converting unit 403 and the driving-current calculating unit 404 can be formed as separated modules or integrated to one unit. The driving-current calculating unit 404 includes a register memory 421, a DEV calculating unit 422, an SW calculating unit 423, and a TH calculating unit 424.

The register memory 421 includes target-value registers for ch1 to ch40, DEV registers for ch1 to ch40, an SW register, and TH registers for ch1 to ch40. These registers will be described in detail later. The driving-current calculating unit 404 sets, at a start-up operation, the target-value registers for ch1 to ch40, the DEV registers for ch1 to ch40, the SW register, and the TH registers for ch1 to ch40 to their default values that are received from the microcontroller 401.

The DEV calculating unit 422 (an example of a correction-value calculating unit) calculates a beam-based current correction value DEV(i) (an example of a correction value) for each laser-beam in accordance with the monitor signal, which is converted by the A/D converting unit 403, or similar. The beam-based current correction value DEV(i) is to correct a current to control light-intensity for each laser-beam. The SW calculating unit 423 (an example of a common-control-value calculating unit) calculates the common-supply-current setting value SW (an example of a common control value) in accordance with the beam-based current correction value DEV(i) etc., wherein the common-supply-current setting value SW is to generate the common supply current Isw that is supplied commonly for every laser beam. The TH calculating unit 424 (an example of a threshold calculating unit) calculates the beam-based threshold-current setting value TH(i) (an example of a threshold) in accordance with the monitor signal, which is converted by the A/D converting unit 403, etc., wherein the beam-based threshold-current setting value TH(i) is to generate the beam-based threshold current Ith(i) that is supplied as the threshold current for each laser beam. The TH calculating unit 424 also calculates the common-supply-current correction value SHD for correcting the common supply current Isw in accordance with shading compensation. Manners of calculation by the DEV calculating unit 422, the SW calculating unit 423, and the TH calculating unit 424 will be described in detail later.

The VCSEL control data contains the beam-based current correction value DEV(i), the common-supply-current setting value SW, the common-supply-current correction value SHD, and the beam-based threshold-current setting value TH(i). The driving-current calculating unit 404 updates the register memory 421 with the calculated beam-based current correction value DEV(i), the calculated common-supply-current setting value SW, and the calculated beam-based threshold-current setting value TH(i).

The VCSEL control data containing the updated beam-based current correction value DEV(i), etc., is sent by the APC control unit 402 to the GAVD 400 and used for light intensity control over the VCSEL 208 in associated with the VCSEL 208's continuous operation and the image forming apparatus's environmental operation. As an initial VCSEL control data, the default current values, which are set by the microcontroller 401, are input to the driver 406 together with a lighting-up signal for each channel. The driver 406 converts the received default current values using PWM, thereby setting the driving current and supplies, to the channel specified by the channel lighting-up signal, the current at the level of the set driving current. When activated by the supplied current, the VCSEL 208 generates laser beams. Part of the generated laser beam of each channel is returned as feedback after passing through a feedback system that is formed by the half mirror 212, the totally reflecting mirror 214, the second condenser lens 216, the photoelectric conversion element 218, etc. and used for the light intensity control over the laser beam. The driving-current calculating unit 404 recalculates the beam-based current correction value DEV(i), the common-supply-current setting value SW, and the beam-based threshold-current setting value TH(i) in accordance with the monitor signal received as a feedback.

Figure 7:
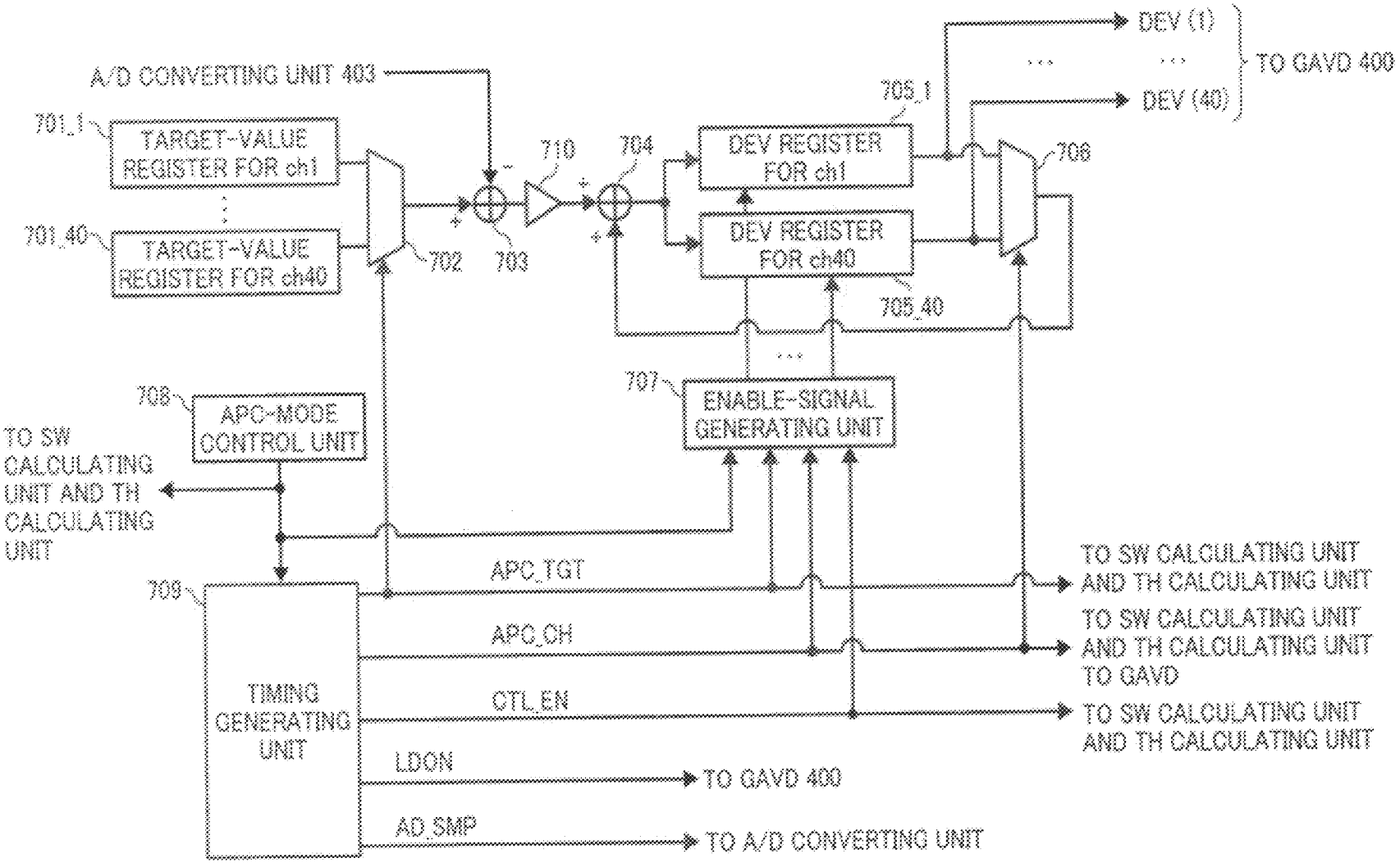
FIG. 7 is a block diagram of the hardware configuration of a DEV calculating unit used in the present embodiment as an example.

FIG. 7 is a block diagram of the hardware configuration of the DEV calculating unit 422 that is used as an example. As shown in FIG. 7, the DEV calculating unit 422 includes an APC-mode control unit 708, a timing generating unit 709, a selector 702, a subtracter 703, a multiplier 710, a selector 706, an adder 704, and an enable-signal generating unit 707. As described above, ch1 target-value registers 701_1 to 701_40 for ch1 to ch40 and DEV registers 705_1 to 705_40 for ch1 to ch40 are included in the register memory 421.

Each of the target-value registers 701_1 to 701_40 for ch1 to ch40 stores therein a predetermined APC target value of each channel. In the present embodiment, each of them is assigned to each channel for each laser diode element of the VCSEL 208. This is because, even when the light intensities or the powers on the imaging surface are the same for every channel of VCSEL, the values of the monitor signals in the individual channels can be different each other due to the different characteristics of their optical systems, etc. Values to be set as the target-value registers 701_1 to 701_40 for ch1 to ch40 are calculated by the microcontroller 401 from the factory setting data or similar that has been stored in the ROM region of the memory 412 and are set by the driving-current calculating unit 404.

The APC-mode control unit 708 controls an APC control mode. The APC control mode will be described later.

The timing generating unit 709 generates a channel specifying signal (APC_CH) that specifies one of the VCSEL channels to which the APC is to be performed; a lighting-up timing signal (LDON) for the VCSEL 208; a sampling timing signal (AD_SMP) for the A/D converting unit 403; later-described update timing signals (CTL_EN) for the DEV registers 705_1 to 705_40 for ch1 to ch40, the SW register, and the TH registers for ch1 to ch140; and a signal APC_TGT indicating whether DEV, SW, or TH is to be controlled.

The selector 702 selects one of target values of APC for channels stored in the target-value registers 701_1 to 701_40 for ch1 to ch40 in accordance with APC_CH generated by the timing generating unit 709 and outputs it to the subtracter 703.

The subtracter 703 subtracts, from the target value of APC for each channel that is received from the selector 702, the monitor signal that is received from the A/D converting unit 403 as the signal indicative of the light intensity of the monitor beam of each channel. The calculated difference is used as deviation from target.

The multiplier 710 multiplies, by gain, the output value of the subtracter 703 or the deviation from target and outputs the product to the adder 704.

The selector 706 outputs an output value stored in the DEV registers 705_1 to 705_40 for ch1 to ch40 to the adder 704 in accordance with APC_CH generated by the timing generating unit 709.

The adder 704 adds the data that is received from the multiplier 710 and the data that is received from the selector 706 and outputs the sum to the DEV registers 705_1 to 705_40 for ch1 to ch40.

The enable-signal generating unit 707 outputs a write enable signal to the target register selected from the DEV registers 705_1 to 705_40 for ch1 to ch40, in accordance with an APC mode signal (APC_MODE) generated by the APC-mode control unit 708, an APC target signal (APC_TGT) generated by the timing generating unit 709, an APC channel specifying signal (APC_CH), and a register update timing signal (CTL_EN).

The DEV registers 705_1 to 705_40 for ch1 to ch40 are updated with (stores therin) the values received from the adder 704 and the updated values are outputs as beam-based current correction values DEV(1) to DEV(40). This update is made at timing when the write enable signal is received from the enable-signal generating unit 707.

With the above-described configuration of the DEV calculating unit 422, when the monitor signal of each channel of the VCSEL 208 received from the A/D converting unit 403 is larger than the target value of each channel, the beam-based current correction value DEV(i) of the corresponding channel is decreased through the feedback control. When the monitor signal is smaller than the target value, the beam-based current correction value DEV(i) of the corresponding channel is increased through the feedback control. In this manner, the light intensity of the laser beam output from each laser diode of the VCSEL 208 is adjusted to the target value under the control of the driver 406.

Figure 8:
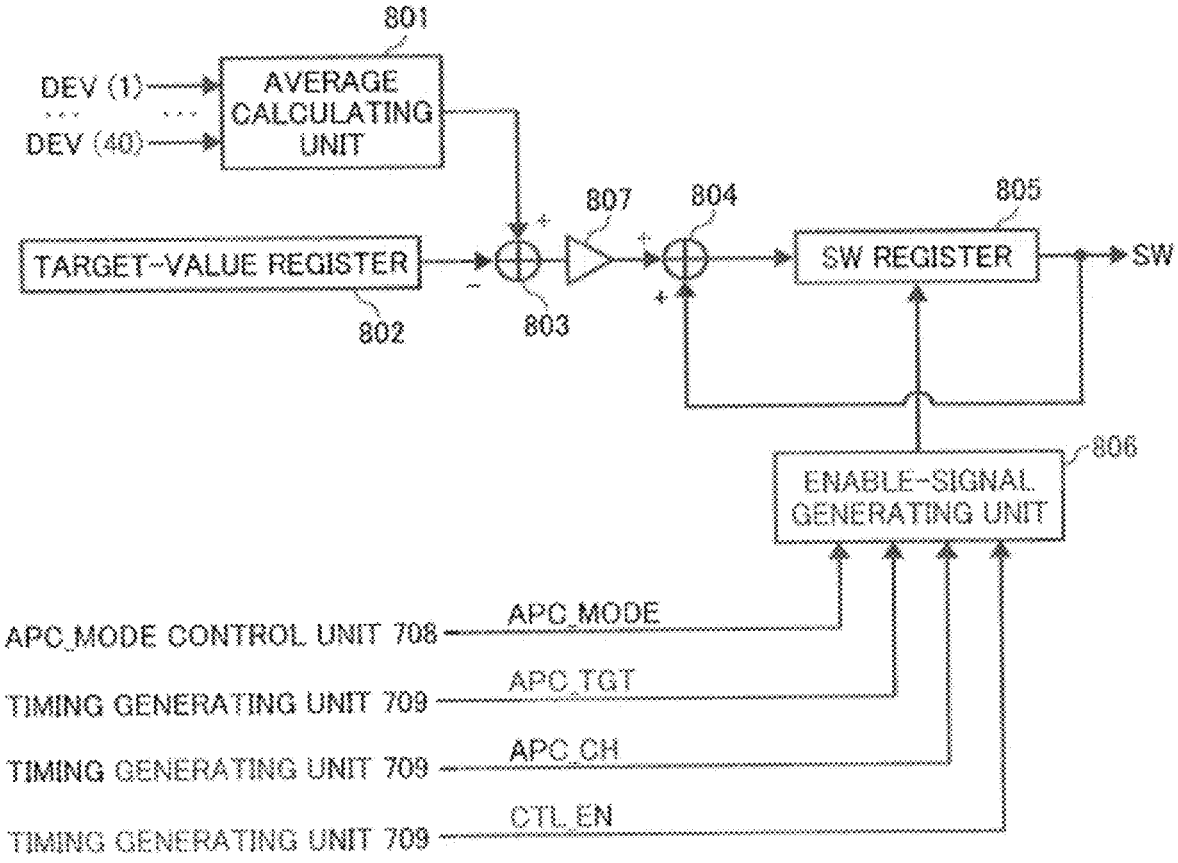
FIG. 8 is a block diagram of the hardware configuration of a SW calculating unit used in the present embodiment as an example.

FIG. 8 is a block diagram of the hardware configuration of the SW calculating unit 423 that is used as an example. As shown in FIG. 8, the SW calculating unit 423 includes an average calculating unit 801, a subtracter 803, a multiplier 807, an adder 804, and an enable-signal generating unit 806. As described above, both a target-value registers 802 and a SW register 805 are included in the register memory 421.

The SW calculating unit 423 performs, during the inter-sheet APC mode, a process for correcting the common-supply-current setting value SW. That is, when the common-supply-current setting value SW is corrected only with the beam-based current correction value DEV(i), there is a possibility that every laser beam of the VCSEL 208 cannot output with the target light intensity. Therefore, the process for correcting the common-supply-current setting value SW is performed so that the common-supply-current setting value SW is within a range in which outputs of every laser beams can be corrected to the target light intensity with the beam-based current correction value DEV(i) from the common-supply-current setting value SW.

The average calculating unit 801 calculates the average of the beam-based current correction values DEV(1) to DEV (40) received from the DEV calculating unit 422. The calculated average is output to the subtracter 803.

The target-value register 802 stores therein a predetermined target value of the average of the beam-based current correction value DEV(i). The SW calculating unit 423 sets the common-supply-current setting value SW so that the average calculated by the average calculating unit 801 is equal to the predetermined target value stored in the target-value register 802.

The subtracter 803 subtracts, from the average received from the average calculating unit 801, the target value stored in the target-value register 802. The difference between the received average value and the target value is used as deviation of average.

The multiplier 807 multiplies, by gain, the deviation of average received from the subtracter 803 and outputs the product to the adder 804.

The adder 804 adds the data that is received from the multiplier 807 and later-described data that is received from the SW register 805 and inputs the sum to the SW register 805.

The enable-signal generating unit 806 determines whether a write access is to be permitted on the basis of the update timing signal (CTL_EN) received from the timing generating unit 709, the APC target signal (APC_TGT), the APC mode signal (APC_MODE) received from the APC-mode control unit 708, and the APC channel specifying signal (APC_CH). When the write access is determined to be permitted, the enable-signal generating unit 806 outputs a write enable signal to the SW register 805.

The SW register 805 stores therein the data received from the adder 804 at timing when the write enable signal that is received from the enable-signal generating unit 806 becomes effective and outputs the data as the common-supply-current setting value SW.

With this configuration, when the average of the beam-based current correction value DEV(i) is larger than the target value, the common-supply-current setting value SW is controlled to be increased. When the average of the beam-based current correction value DEV(i) is smaller than the target value, the common-supply-current setting value SW is controlled to be decreased.

Although, in the present embodiment, the common-supply-current setting value SW is calculated using the average of the beam-based current correction value DEV(i) as a feedback, the common-supply-current setting value SW can be calculated using the average of the maximum value and the minimum value of the beam-based current correction value DEV(i) instead of the average of the beam-based current correction value DEV(i). If such configuration is taken, the probability increases that the light intensity is adjusted appropriately in a situation one or some defect channels are present in the VCSEL channels.

Figure 9:
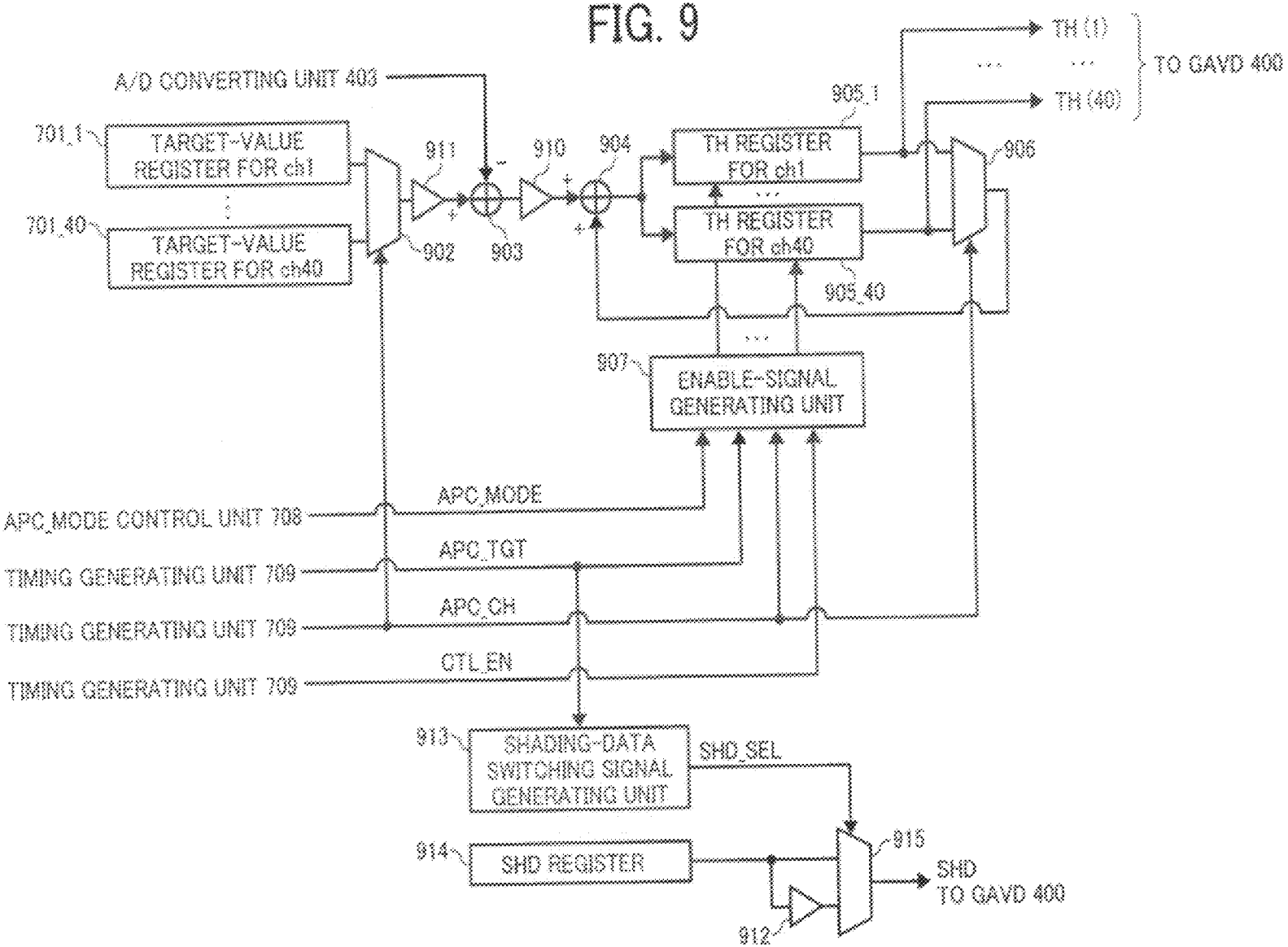
FIG. 9 is a block diagram of the hardware configuration of a TH calculating unit used in the present embodiment as an example.

FIG. 9 is a block diagram of the hardware configuration of the TH calculating unit 424 that is used as an example. As shown in FIG. 9, the TH calculating unit 424 includes a selector 902, a multiplier 911, a subtracter 903, a multiplier 910, an enable-signal generating unit 907, a selector 906, an adder 904, a shading-data switching signal generating unit 913, a multiplier 912, and a selector 915. As described above, the target-value registers 701_1 to 701_40 for ch1 to ch40, TH registers 905_1 to 905_40 for ch1 to ch40, and an SHD register 914 are included in the register memory 421.

The TH calculating unit 424 performs, during the inter-sheet APC mode, a process for correcting the beam-based threshold-current setting value TH(i). More particularly, the TH calculating unit 424 corrects the beam-based threshold-current setting value TH(i) so that the light intensity of the laser beam driven, under the control of the driver 406, by "common-supply-current correction value SHD2*beam-based current correction value DEV(i)*common supply current Isw+beam-based threshold current Ith(i)" is equal to the product of the light intensity of the laser beam driven by "common-supply-current correction value SHD1*beam-based current correction value DEV(i)*common supply current Isw+beam-based threshold current Ith(i)" and a multiplier (common-supply-current correction value SHD2/common-supply-current correction value SHD1).

The selector 902 selects one of APC target values for every channels stored in the target-value registers 701_1 to 701_40 for ch1 to ch40 in accordance with APC_CH generated by the timing generating unit 709 and outputs the selected APC target value to the multiplier 911.

The multiplier 911 multiplies the APC target value of each channel that is received from the selector 702 by SHD2/SH1 that is the ratio of the correction value SHD2 for the TH control to the correction value SHD1 for the normal APC control and outputs the product to the subtracter 903.

The subtracter 903 subtracts, from the output value of the multiplier 911, the monitor signal that is received from the A/D converting unit 403 as the signal indicative of the light intensity of the monitor beam of each channel. The calculated difference is used as deviation from target.

The multiplier 910 multiplies, by gain, the output value of the subtracter 903 or the deviation from target and outputs the product to the adder 904.

The enable-signal generating unit 907 outputs a write enable signal to the target register selected from the TH registers 905_1 to 905_40 for ch1 to ch40, in accordance with the APC mode signal (APC_MODE) generated by the APC-mode control unit 708, the APC target signal (APC_TGT) generated by the timing generating unit 709, the APC channel specifying signal (APC_CH), and the register update timing signal (CTL_EN).

The selector 906 outputs, in accordance with APC_CH generated by the timing generating unit 709, an output value stored in the TH registers 905_1 to 905_40 for ch1 to ch40 to the adder 904.

The adder 904 adds the output value of the multiplier 910 and the output value of the selector 906 and outputs the sum to the TH registers 905_1 to 905_40 for ch1 to ch40.

The TH registers 905_1 to 905_40 for ch1 to ch40 are updated with (stores therein) the values received from the adder 904 and the updated values are output as beam-based current setting values TH(1) to TH(40). This update is made at timing when the write enable signal is received from the enable-signal generating unit 907.

The shading-data switching signal generating unit 913 receives the APC target signal APC_TGT from the timing generating unit 709 as an input signal. The shading-data switching signal generating unit 913 outputs a high-level SHD_SEL signal when TH is to be adjusted and outputs a low-level SHD_SEL when TH is not to be adjusted.

The SHD register 914 stores therein the correction data that is used for correcting the common-supply-current setting value SW during the normal APC and is set at the default settings.

The multiplier 912 multiplies the correction data that is received from the SHD register 914 by SHD2/SHD1 that is the ratio of the correction value SHD2 for the TH control to the correction value SHD1 for the normal APC control and outputs the product to the selector 915.

Thus, when the normal APC (DEV or SW is to be controlled) is performed, the correction data stored in the SHD register 914 is output from the selector 915 as the SHD data. When the TH is to be controlled, the correction data stored in the SHD register 914 multiplied by SHD2/SHD1 is output from the selector 915 as the SHD data.

With the above-described configuration of the TH calculating unit 424, when the monitor signal of each channel of the VCSEL 208 received from the A/D converting unit 403 is larger than the target value in each channel, the beam-based threshold-current setting value TH(i) of the corresponding channel is decreased through the feedback control. When the monitor signal is smaller than the target value, the beam-based threshold-current setting value TH(i) of the corresponding channel is increased through the feedback control. In this manner, the light intensity of the laser beam output from each laser diode of the VCSEL 208 is adjusted to the target value.

Figure 10:
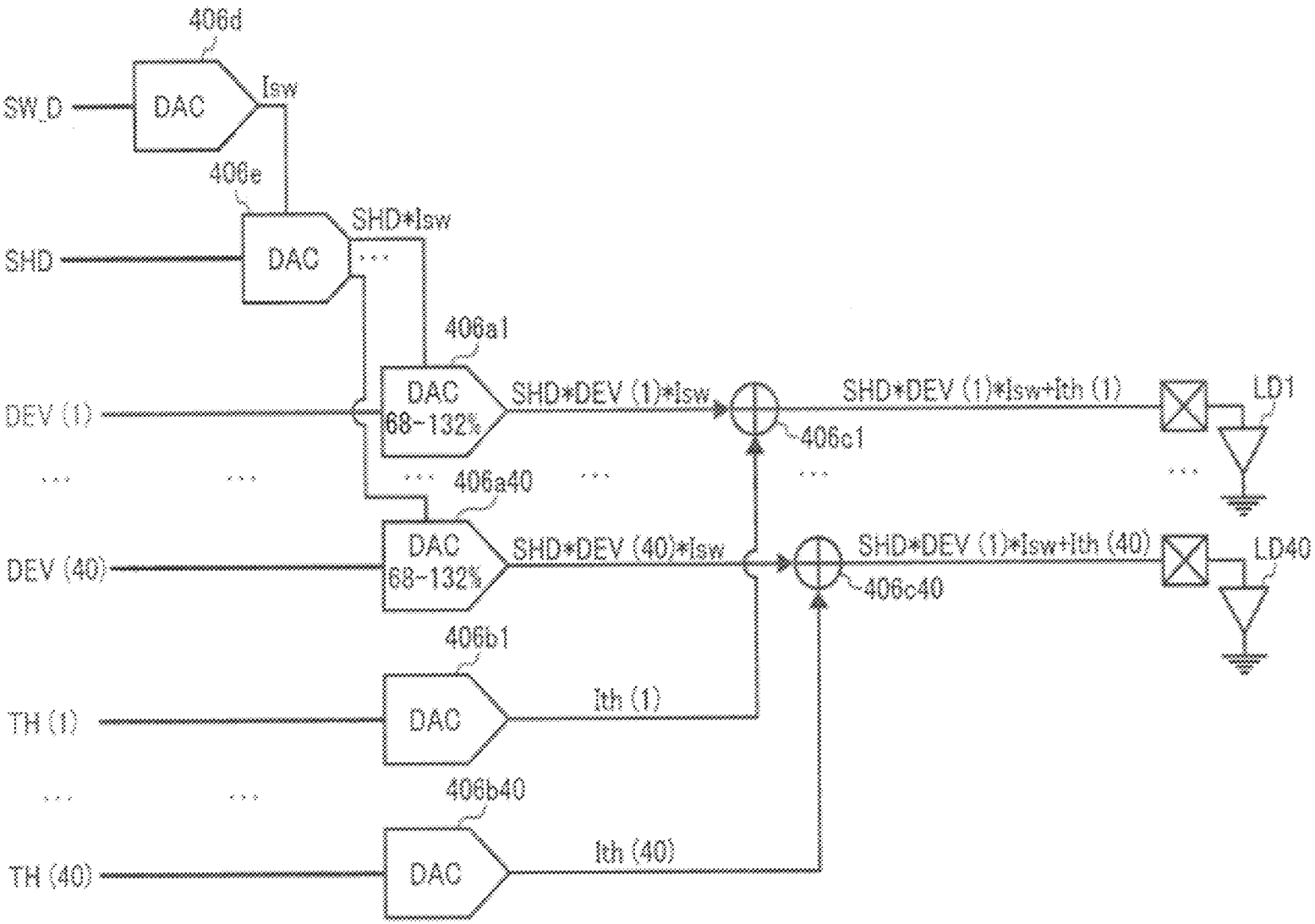
FIG. 10 is a block diagram of the hardware configuration of a driver used in the present embodiment as an example.

FIG. 10 is a block diagram of the hardware configuration of the driver 406 that is used as an example. As shown in FIG. 10, the driver 406 includes a common-supply-current unit 406*d* and a common-supply-current correcting unit 406*e*. The driver 406 includes correction-value setting units 406*a*1 to 406*a*40, threshold-current generating units 406*b*1 to 406*b*40, and current adding units 406*c*1 to 406*c*40 in associated with the channels ch1 to ch40 of the VCSEL 208 emitting laser-beams, respectively.

The common-supply-current unit 406*d* generates the common supply current Isw in accordance with the received common-supply-current setting value SW. The common-supply-current correcting unit 406*e* corrects the common supply current Isw using both the common supply current Isw and the common-supply-current correction value SHD and outputs a corrected common supply current (SHD*Isw), which in obtained by correcting the common supply current Isw.

The correction-value setting units 406*a*1 to 406*a*40 correct the corrected common supply current (SHD*Isw) using the beam-based current correction values DEV(1) to DEV(40) and output the corrected currents (SHD*DEV(i)*Isw). The correction-value setting units 406*a*1 to 406*a*40 can correct the value of the corrected common supply current (SHD*Isw) within a range from 68% to 132%. Therefore, the correction-value setting units 406*a*1 to 406*a*40 correct the corrected common supply current (SHD*Isw) so that the average of the beam-based current correction value DEV(i) corresponds to 100%, which prevents the beam-based current correction value DEV(i) from taking a value without the correctable range.

Each of the threshold-current generating units 406*b*1 to 406*b*40 generates the beam-based threshold current Ith(i) of the corresponding channel of the VCSEL 208 in accordance with the beam-based threshold-current setting value TH(i).

Each of the current adding units 406*c*1 to 406*c*40 adds the beam-based threshold current Ith(i) of the corresponding channel generated by the threshold-current generating units 406*b*1 to 406*b*40 to the corrected channel-based current. After that, each of the current adding units 406*c*1 to 406*c*40 outputs a current used to drive the corresponding channel of the VCSEL and supplies the channel driving current to the corresponding channel of the VCSEL 208.

With the above-described configuration of the driver 406, in the present embodiment, the driving current SHD*DEV(i)*Isw+Ith(i) is supplied to a laser diode LD (i) of each channel.

Figure 11:
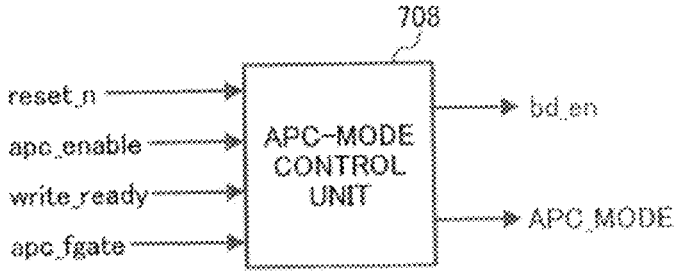
FIG. 11 is a block diagram of an APC-mode control unit of the present embodiment with its input/output signals illustrated as examples.

FIG. 11 is a block diagram of the APC-mode control unit 708 with its input/output signals illustrated as examples. As shown in FIG. 11, the APC-mode control unit 708 receives a reset signal (reset_n), an APC enable signal (apc_enable), a write_ready signal, and an apc_fgate signal as input signals and outputs a bd_en signal and an APC_MODE signal as output signals. The APC-mode control unit 708 performs control of APC-mode on the basis of the received signals.

The reset signal (reset_n) is used to initialize the APC-mode control unit 708 and received from the CPU 408. The APC enable signal (apc_enable) indicates whether it is ready for the APC and is received from the CPU 408. The write_ready signal indicates whether it is ready for writing (whether a main-scanning synchronization process is completed) and is received from the GAVD 400. The apc_fgate signal indicates timing of the inter-sheet and is received from the CPU 408. The apc_fgate signal at a low-level is received when it is in the inter-sheet timing, while the apc_fgate signal at a high-level is received when it is not in the inter-sheet timing.

Figure 12:
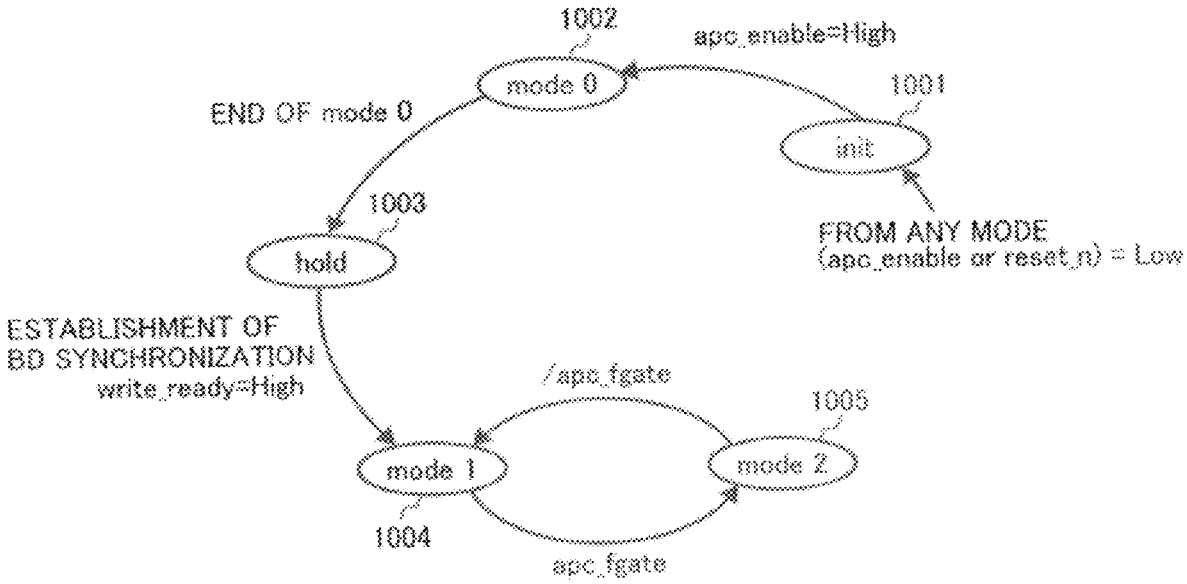
FIG. 12 is a schematic diagram that explains mode shift of the APC-mode control unit according to the present embodiment as an example.

FIG. 12 is a schematic diagram that explains mode shift of the APC-mode control unit 708. When the reset signal (reset_n) is at a low-level, the APC-mode control unit 708 always shifts to an "init" 1001, regardless of the current mode. When the apc_enable signal is switched to a low level, the APC-mode control unit 708 shifts to the "init" 1001.

When the received APC enable signal (apc_enable) is switched to a high-level when the current APC mode of the APC-mode control unit 708 is the "init" 1001, the APC mode is shifted to a "mode0" 1002.

When the APC process is repeated specified number of cycles during the "mode0" 1002, the APC mode is shifted to a "hold" 1003. The specified number of cycles of the APC process is preliminarily set by the microcontroller 401 and stored in the register memory 421 included in the driving-current calculating unit 404.

When the APC mode of the APC-mode control unit 708 is shifted to the "hold" 1003, the APC-mode control unit 708 sends the bd_en signal at a high-level to the GAVD 400. Thereby, the GAVD 400 starts the main-scanning synchronization process (hereinafter, "BD synchronization process"). After the GAVD 400 completes the BD synchronization process, the GAVD 400 inputs the write_ready signal at a high-level to the APC-mode control unit 708. Upon receiving the high-level write_ready signal, the APC-mode control unit 708 shifts to a "mode1" 1004. The inter-sheet APC is performed during the "mode1".

After that, when the APC-mode control unit 708 receives the apc_fgate signal at a high-level when the APC mode is the "mode1" 1004, the APC mode is shifted to a "mode2" 1005. The line APC is performed during the "mode2".

When the APC-mode control unit 708 receives the apc_fgate signal at a low-level when the APC mode is the "mode2" 1005, the APC mode is returned to the "mode1" 1004. In this manner, the APC-mode control unit 708 switches between the "mode1" and the "mode2" in accordance with a switch between the high-level and the low-level of the apc_fgate.

The APC-mode control unit 708 outputs APC_MODE indicative of the above-described APC mode to each of the timing generating unit 709, the SW calculating unit 423, and the TH calculating unit 424.

Figure 13:
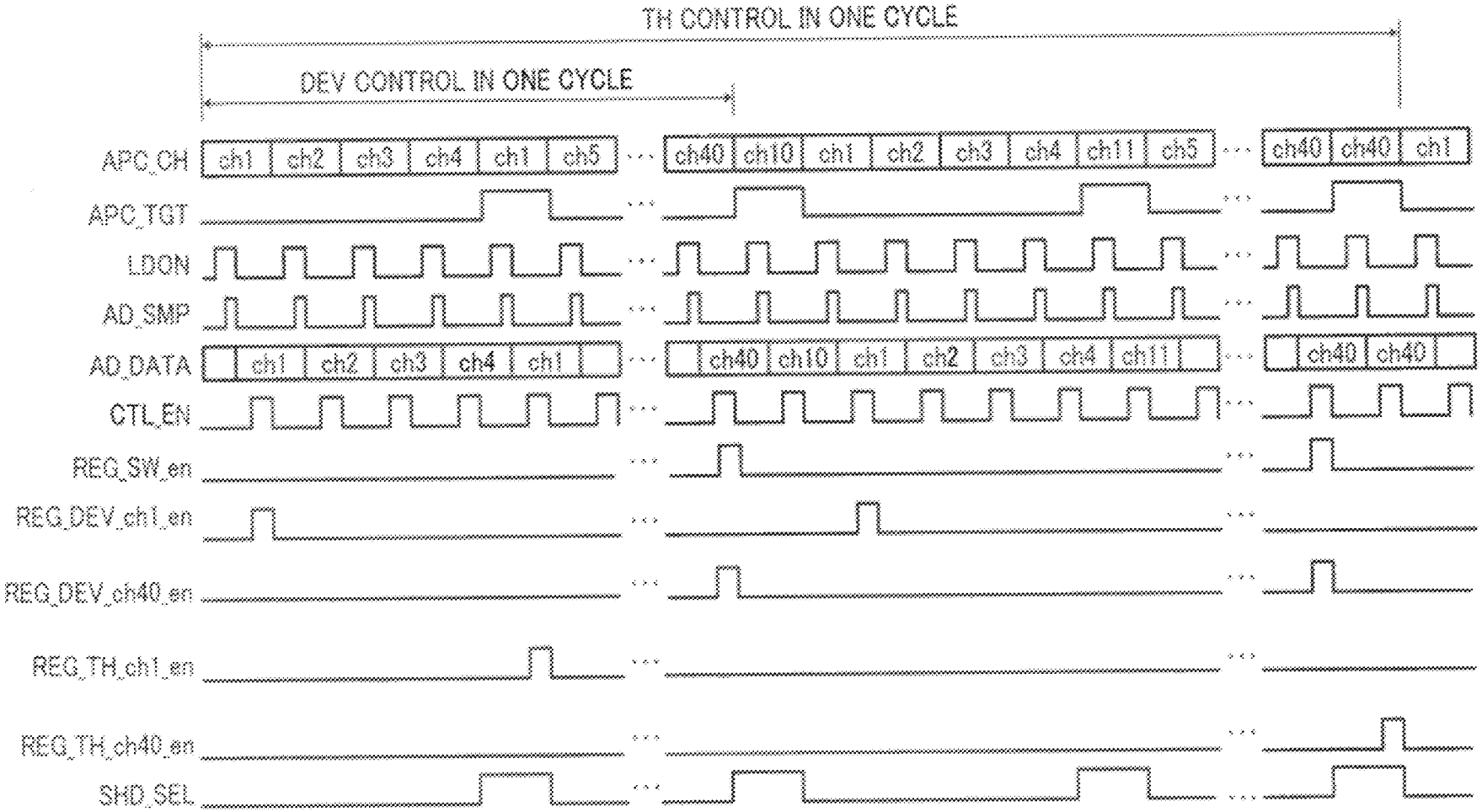
FIG. 13 is a timing chart of an example when APC_MODE is mode0.

FIG. 13 is a timing chart of an example when APC_MODE is the "mode0", more particularly, a timing chart of the signals generated by the timing generating unit 709, the enable-signal generating unit 707, the enable-signal generating unit 806, the enable-signal generating unit 907, and the shading-data switching signal generating unit 913 when APC_MODE is the "mode0".

In the example shown in FIG. 13, the APC_CH signal indicates timing for a process for each of the channels from ch1 to ch40. The timing generating unit 709 generates the APC_CH signals so that the APC is repeated a predetermined number of cycles that is specified by the microcontroller 401, in which one cycle corresponds to a set of operations from ch1 to ch40. Thus, the APC control for each channel is repeated the specified number of cycles.

The timing generating unit 709 generates a lighting-up timing signal (LDON) of each channel of the VCSEL 208 in accordance with APC_CH to be generated and outputs the lighting-up timing signal (LDON) to the GAVD 400. The timing generating unit 709 also generates a sampling timing signal (AD_SMP) in accordance with APC_CH to be generated and outputs the sampling timing signal (AD_SMP) to the A/D converting unit 403.

After that, the timing generating unit 709 generates an update timing signal (CTL_EN) in accordance with a result of the process that has been performed in response to the output signal, in which the update timing signal (CTL_EN) indicates timing to update the register memory 421 by the driving-current calculating unit 404. The timing generating unit 709 outputs the update timing signal (CTL_EN) to both the enable-signal generating unit 707 and the enable-signal generating unit 806.

The enable-signal generating unit 707 generates write enable signals REG_DEV_ch1_en to REG_DEV_ch40_en to instruct to update the registers (the DEV registers 705_1 to 705_40 for ch1 to ch40) of specified channels in accordance with the received APC mode signal (APC_MODE), the received register update timing signal (CTL_EN), the received channel specifying signal (APC_CH), and the received APC target signal (APC_TGT). Thereby, the DEV registers 705_1 to 705_40 for ch1 to ch40 are updated.

In the same manner, the enable-signal generating unit 907 generates write enable signals REG_TH_ch1_en to REG_TH_ch40_en to instruct to update the register (the TH registers 905_1 to 905_40 for ch1 to ch40) of specified channels in accordance with the received APC mode signal (APC_MODE), the received register update timing signal (CTL_EN), the received channel specifying signal (APC_CH), and the received APC target signal (APC_TGT). Thereby, the TH registers 905_1 to 905_40 for ch1 to ch40 are updated.

The enable-signal generating unit 806 generates a write enable signal REG_sw_en to instruct to update the SW register 805 in accordance with the received APC mode signal (APC_MODE), the received register update timing signal (CTL_EN), and the received channel specifying signal (APC_CH). More particularly, if APC_MODE="mode0", the REG_sw_en signal to enable is generated when the register update timing signal (CTL_EN) is switched to the high level during APC_CH=ch40. With this configuration, after the DEV registers for all the channels from ch1 to ch40 are updated, the process starts for updating the common supply current Isw.

The shading-data switching signal generating unit 913 outputs a high-level signal when APC_TGT indicates that it is a phase in which TH should be adjusted through the APC control.

Figure 14:
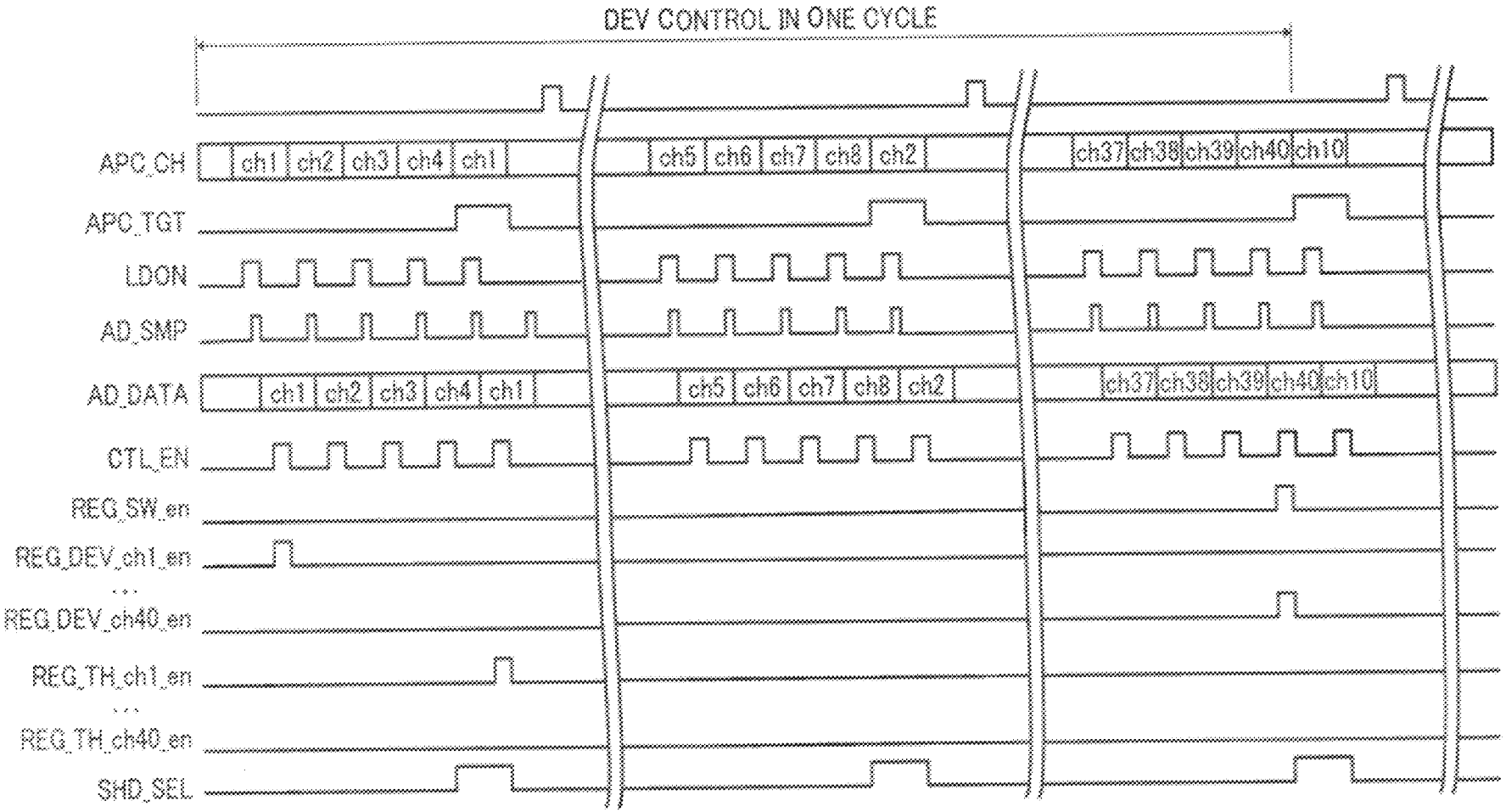
FIG. 14 is a timing chart of an example when APC_MODE is either mode1 or mode2.

FIG. 14 is a timing chart of an example when APC_MODE is either the "mode1" or the "mode2", more particularly, a timing chart of the signals generated by the timing generating unit 709, the enable-signal generating unit 707, and the enable-signal generating unit 806 when APC_MODE is either the "mode1" or the "mode2". In the example shown in FIG. 14, the light intensity correction is performed while causing the VCSEL 208 to illuminate an area out of an area where an image is formed immediately before a line clear signal (LCLR) is generated to start main-scanning using the VCSEL 208.

In the example shown in FIG. 14, timing signals enabling APC control of 2 channels during one main-scanning are shown. In other words, APC_CH signals for two channels are generated during one scan. The process the same as the process in the "mode0" shown in FIG. 13 is performed after the issue of APC_CH until the generation of the enable signal; therefore, the description of the same process is not repeated. It is allowable to increase the number of APC channels that are adjusted during one scan if there is enough time.

The update of the SW register 805 that stores therein the common-supply-current setting value SW affects the light intensity of the laser beam of every channel of the VCSEL. It means that, if the common-supply-current setting value SW is updated during image formation, an image with a drastic density change is formed. Therefore, when the "mode2" during which the line APC is performed is selected, the enable-signal generating unit 806 does not generate a signal to update so that the common-supply-current setting value SW is not adjusted.

Because the update of the beam-based threshold-current setting value TH(i) produces a disturbance of the DEV control, there is a possibility that the density of the image changes drastically. Therefore, when the "mode2" is selected, the enable-signal generating unit 907 does not generate signal to update so that TH control is also not performed.

Therefore, the enable-signal generating unit 806 receives CTL_EN, APC_MODE, APC_TGT, and APC_CH. If the APC_MODE indicative of the "mode1", the APC_TGT at a low-level, and the APC_CH indicative of ch40 are received and when the CTL_EN is at a high level, the enable-signal generating unit 806 outputs the enable signal at a high-level. If APC_MODE is the "mode2", then the enable-signal generating unit 806 always outputs the enable signal at a low-level.

The enable-signal generating unit 907 receives CTL_EN, APC_MODE, APC_TGT, and APC_CH. If the APC_MODE indicative of the "mode1" and the APC_TGT at a high-level are received and when the CTL_EN is at a high level, the enable-signal generating unit 907 outputs the enable signal for the channel indicated by APC_CH at a high-level. If APC_MODE indicates the "mode2", the enable-signal generating unit 907 always outputs the enable signal at a low-level.

As described above, in the present embodiment, when the "mode1" is selected, the beam-based current correction value DEV(i), the common-supply-current setting value SW, and the beam-based threshold-current setting value TH(i) are controlled. When the "mode2" is selected, only the beam-based current correction value DEV(i) is controlled. However, control is not limited thereto. For example, it can be configured to be able to set whether the beam-based current correction value DEV(i), the common-supply-current setting value SW, and the beam-based threshold-current setting value TH(i) are to be controlled depending on each mode. If such a configuration is taken, control can be performed appropriately in accordance with the situation.

As described above, the image forming apparatus according to the present embodiment includes the control system (second control loop) that controls the light intensities of all the laser beams, the control system (first control loop) that corrects an error of the light intensity of each laser beam, and the control system (third control loop) that adjusts the threshold current so that the relation between the amount of change of the driving current and the amount of change of the expected light intensity is consistent with the slope of the I-L curve near the target light intensity.

According to the present embodiment, because not only the common supply current Isw but also the beam-based threshold-current setting value TH(i) are adjusted, even if a VCSEL having many channels is used, accurate light intensity control is performed and accurate and high-speed shading compensation is achieved.

Especially, in the present embodiment, the beam-based threshold-current setting value TH(i) is adjusted so that the light intensity of the laser beam that is driven by "common-supply-current correction value SHD2*beam-based current correction value DEV(i)*common supply current Isw+beam-based threshold current Ith(i)" is equal to the product of the light intensity of the laser beam that is driven by "common-supply-current correction value SHD1*beam-based current correction value DEV(i)*common supply current Isw+beam-based threshold current Ith(i)" and a multiplier (common-supply-current correction value SHD2/common-supply-current correction value SHD1). Therefore, according to the present embodiment, even if the I-L characteristic is not in a direct proportional relation, the light intensity of each laser beam can be corrected to a target light intensity and accurate shading compensation can be achieved.

Figure 15:
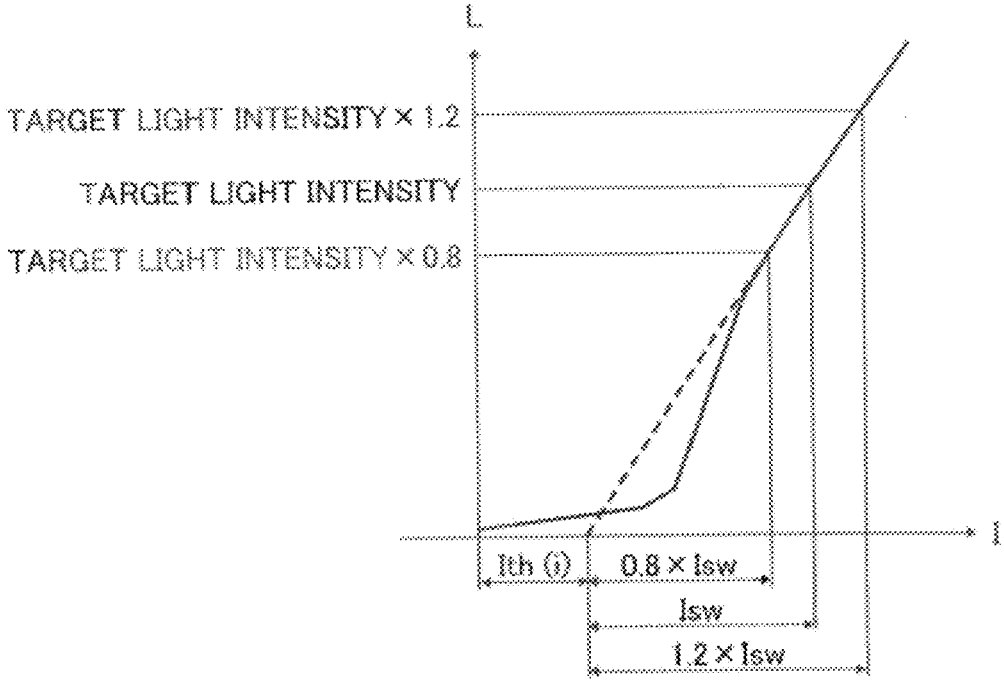
FIG. 15 is a graph of the I-L curve of a laser beam output, as an example, from the VCSEL according to the present embodiment.

FIG. 15 is a graph of the I-L curve of the laser beam output, as an example, from the VCSEL 208 according to the present embodiment. In the example shown in FIG. 15, the common supply current Isw is corrected using the beam-based current correction value DEV(i) so that, when the value of the driving current I(i) is equal to "beam-based threshold current Ith(i)+common supply current Isw", the light intensity of the laser beam (i) is equal to a target light intensity. The beam-based threshold-current setting value TH(i) is adjusted so that, when the value of the driving current I(i) is equal to "beam-based threshold current Ith(i)+0.8*common supply current Isw", the light intensity of the laser beam (i) is equal to the target light intensity multiplied by 0.8. Moreover, the beam-based threshold-current setting value TH(i) is adjusted so that, when the value of the driving current I(i) is equal to "beam-based threshold current Ith(i)+1.2*common supply current Isw", the light intensity of the laser beam (i) is equal to the target light intensity multiplied by 1.2. With this configuration, even if I-L characteristic is not in a direct proportional relation, the light intensity of the laser beam (i) is in a direct proportion to the light intensity of the common supply current Isw near the target light intensity; therefore, accurate shading compensation is achieved by driving the VCSEL by the common supply current Isw multiplied by a coefficient that is determined depending on a predetermined shading compensation value. Although, in the example shown in FIG. 15, the coefficient is set to 0.8 and 1.2, the coefficient can be set to any value appropriately depending on a shading compensation range.

Figure 16:
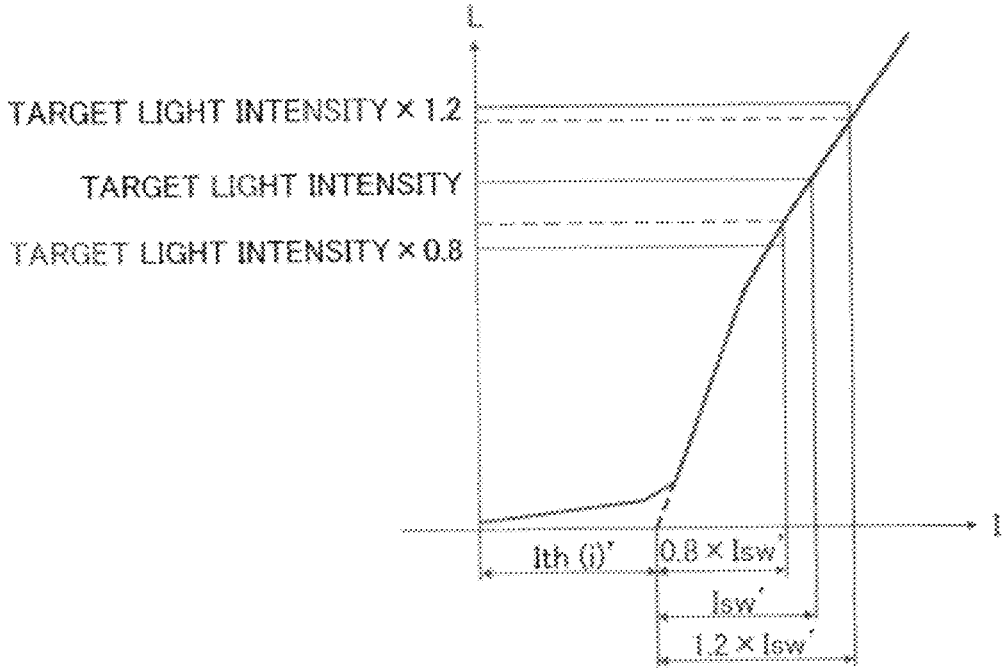
FIG. 16 is a graph of the I-L curve of a laser beam, as an example, that is not controlled in the same manner as in the present embodiment, and in which the I-L characteristic of the laser beam is not in a direct proportional relation.

As a comparison example, the I-L curve of another laser beam that is not controlled in the same manner as in the present embodiment is shown in FIG. 16, and in which the I-L characteristic of the laser beam is not in a direction proportional relation. In the example shown in FIG. 16, because the I-L characteristic is not in a direction proportional relation, slope of the I-L curve is not constant. In this case, even if the shading compensation corresponding to multiplication by a coefficient is performed by controlling the value of the driving current I(i) to "beam-based threshold current Ith(i)'+the coefficient (0.8 to 1.2)*common supply current Isw'", the light intensity of the laser beam (i) cannot be set equal to a target light intensity multiplied by the coefficient and, in turn, an error of the shading compensation value occurs. The error of the shading compensation value is ignorable when the amount of change in the slope of the I-L curve is small; however change of the slope of the I-L curve is large in most VCSELs and the error is not likely to be ignorable. Accordingly, it is difficult to perform accurate shading compensation with the example shown in FIG. 16.

Moreover, as an effect of the present embodiment, it is possible to perform high-speed light intensity control; therefore, even when the temperature of the light source changes drastically in a situation, for example, that all the channels of the light source light up at a high power, the light intensity can be adjusted accurately following up the drastic temperature change.

In this way, according to the present invention, high-speed light intensity control of a light source that outputs many laser beams can be performed and high-speed and accurate shading compensation can be achieved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a light source that outputs a plurality of laser beams;

a splitting unit that splits each of the laser beams into a first laser beam that is used for light intensity control and a second laser beam that is used to scan a photosensitive element;

a light-intensity-signal output unit that outputs for each of the first laser beams a corresponding light intensity signal that is indicative of the light intensity thereof; and a control unit that adjusts the light intensity of each of the laser beams to a target light intensity by referring to the light intensity signal, wherein the control unit includes a common-control-value calculating unit that calculates a common control value that is used for light intensity control of every laser beam;

a correction-value calculating unit that calculates a correction value for each of the laser beams, wherein the correction value is used to correct the common control value; and a threshold calculating unit that calculates a threshold of each of the laser beams, wherein the threshold corresponds to a value of current at which oscillation of the laser beam starts, the correction-value calculating unit calculates the correction value so that, when the laser beam is driven by a first control value, the light intensity of the laser beam is equal to the target light intensity, wherein the first control value is a value calculated by correcting the common control value using the correction value to obtain a corrected control value and adding the threshold to the corrected control value, and the threshold calculating unit calculates the threshold so that, when the laser beam is driven by a second control value, the light intensity of the laser beam is equal to the target light intensity multiplied by a predetermined factor, wherein the second control value is a value calculated by correcting the common control value using the correction value to obtain the corrected control value, multiplying the corrected control value by the predetermined factor to obtain a multiplied control value, and adding the threshold to the multiplied control value.

2. The image forming apparatus according to claim 1, wherein the common-control-value calculating unit, the correction-value calculating unit, and the threshold calculating unit calculate the common control value, the correction value, and the threshold, respectively using a feedback system.

3. The image forming apparatus according to claim 1, wherein the common-control-value calculating unit calculates the common control value only during a period after an image is formed on an arbitrary recording sheet and before another image is formed on a recording sheet that follows the arbitrary recording sheet.

4. The image forming apparatus according to claim 1, wherein the threshold calculating unit calculates the threshold only during a period after an image is formed on an arbitrary recording sheet and before another image is formed on a recording sheet that follows the arbitrary recording sheet.

5. A light intensity control method performed by an image forming apparatus, wherein the image forming apparatus includes a light source that outputs a plurality of laser beams;

a splitting unit that splits each of the laser beams into a first laser beam that is used for light intensity control and a second laser beam that is used to scan a photosensitive element; and a light-intensity-signal output unit that outputs for each of the first laser beams a corresponding light intensity signal that is indicative of the light intensity thereof, the light intensity control method comprising:

calculating, by a common-control-value calculating unit, a common control value that is used for light intensity control of every laser beam;

calculating, by a correction-value calculating unit, a correction value for each of the laser beams, wherein the correction value is used to correct the common control value; and calculating, by a threshold calculating unit, a threshold of each of the laser beams, wherein the threshold corresponds to a value of current at which oscillation of the laser beam starts, wherein the correction-value calculating unit calculates, in the calculating, the correction value so that the light intensity of the laser beam is equal to a target light intensity when the laser beam is driven by a first control value, wherein the first control value is calculated by correcting the common control value using the correction value to obtain a corrected control value and adding the threshold to the corrected control value, and the threshold calculating unit calculates, in the calculating, the threshold so that, when the laser beam is driven by a second control value, the light intensity of the laser beam is equal to the target light intensity multiplied by a predetermined factor, wherein the second control value is a value calculated by correcting the common control value using the correction value to obtain the corrected control value, multiplying the corrected control value by the predetermined factor to obtain a multiplied control value, and adding the threshold to the multiplied control value.

* * * * *